United States Patent [19]

Kojak

[11] Patent Number: 4,802,351

[45] Date of Patent: Feb. 7, 1989

[54] SLIDING BOLT LOCK FOR GATES

[76] Inventor: George Kojak, 2241 23rd St., Beaumont, Tex. 77706

[21] Appl. No.: 191,976

[22] Filed: May 9, 1988

[51] Int. Cl.[4] ..... E05B 67/38

[52] U.S. Cl. ..... 70/56; 70/39; 70/129; 292/148

[58] Field of Search ..... 70/26, 39, 54, 56, 129, 70/134, 417; 292/148

[56] References Cited

U.S. PATENT DOCUMENTS

| | | | |
|---|---|---|---|
| 1,490,988 | 4/1924 | Soref . | |
| 2,358,914 | 9/1944 | Drax | 292/148 |
| 3,655,229 | 4/1972 | Tumbiolo | 292/148 |
| 3,752,518 | 8/1973 | Cannell | 292/148 |
| 4,021,063 | 5/1977 | Porter | 292/67 |
| 4,095,828 | 6/1978 | East | 292/148 |
| 4,229,956 | 10/1980 | Thorburn | 70/129 |
| 4,234,220 | 11/1980 | Finch | 292/148 |
| 4,438,641 | 3/1984 | Levkov | 70/54 |
| 4,512,105 | 4/1985 | Norton | 49/394 |
| 4,565,079 | 1/1986 | Smith | 70/134 |

*Primary Examiner*—Robert L. Wolfe

*Attorney, Agent, or Firm*—Norman B. Rainer

[57] ABSTRACT

A lock is provided for use on outdoor gate structures. The lock is of rugged, durable construction, intended to resist malfunction due to weather factors, and amenable to repair and change of keys. The lock is comprised of a sturdy metal housing having a bolt that moves between front and rear extremities of the housing in sliding engagement with front and rear apertured transverse walls. A padlock fits within the rear extremity of the housing, and its presence prevents rearward movement of the bolt to the opened state of the lock.

10 Claims, 4 Drawing Sheets

SLIDING BOLT LOCK FOR GATES

BACKGROUND OF THE INVENTION

This invention concerns means for locking the free end of a pivotably mounted door or gate to an interactive stationary vertical member such as a post, door jamb or the like.

Outdoor ornamental and security iron work gates and doors require locking mechanisms that are of sturdy construction and resistant to deterioration or malfunction due to weather factors. It is desirable that the lock mechanism additionally serve as a manually operable latch to secure the gate in the closed position, namely preventing free swinging movement of the gate with respect to the gate post.

Numerous gate locking devices have earlier been disclosed taking cognizance of the aforesaid criteria. However, the versatility of such devices and their reliability have generally been incompatible with or compromised by specially emphasized features of construction or use. In certain earlier devices key-operated padlocks are exposed to weather factors and their interactive shackle posts are vulnerable to severance by bolt-cutting devices. In other earlier locking devices adapted for welded attachment to a gate, the key locking mechanism cannot be easily serviced or replaced.

It is accordingly an object of the present invention to provide a locking device for a gate which utilizes a sliding bolt that functions as both a lock and a latch mechanism.

It is another object of this invention to provide a locking device as in the foregoing object, the security of which is assured by means of a padlock mechanism.

It is a further object of the present invention to provide a locking device of the aforesaid nature wherein said padlock mechanism is inaccessible to a bolt cutter and protected from entrance of water, yet removable for replacement.

It is yet another object of this invention to provide a locking device of the aforesaid nature capable of welded attachment to a gate system, and of a sturdy, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a lock for gate structures comprising:

(a) a sturdy metal housing elongated upon a centered axis between front and rear extremities, and comprised of opposed side panels and opposed end panels, said panels being joined in a box-like configuration having an interior of uniformly rectangular contour, (b) a first transverse wall disposed within said housing adjacent said front extremity in perpendicular orientation to said axis and having an aperture therein centered upon said axis, (c) a second transverse wall, bounded by opposed interior and exterior surfaces, disposed within said housing close to said rear extremity in perpendicular orientation to said axis and having an aperture therein centered upon said axis, (d) two parallel shackle posts attached to the exterior surface of said second transverse wall at sites equidistantly spaced from said axis and extending perpendicularly therefrom to distal extremities located rearwardly of the rear extremity of the housing, (e) bolt means having forward and rearward extremities defining a length greater than the distance of separation between said transverse walls, said bolt means being slidably held by the apertures in said walls, (f) a manipulating arm perpendicularly attached to said bolt and extending through a close-fitting slotted opening in one of said end panels, (g) means for limiting the extent of sliding motion of the bolt means in forward and rearward directions, (h) a padlock configured to enter the rear extremity of said housing while engaging said shackle posts, said padlock having a rearwardly directed key-receiving extremity and an opposite, forwardly directed bottom extremity, whereby (i) when said padlock is emplaced upon said shackle posts, the rearward extremity of said bolt means abuts against the bottom extremity of said padlock, thereby fixing the forward extremity of the bolt means in a disposition forwardly displaced from the front extremity of the housing, and (j) when said padlock is removed, said bolt means can slide rearwardly so that its forward extremity no longer protrudes forwardly of said housing.

In preferred embodiments of the invention, the padlock is adapted to make close-fitting sliding engagement with the interior of the housing. The shackle posts may be either welded to the exterior surface of the second transverse wall, or threadably attached to said wall in a manner such that emplacement of the padlock thwarts removal of the posts. The authorized removability of the shackle posts permits replacement of worn or corroded posts.

In one embodiment, the interaction between the padlock and shackles may be such that, in its unlocked state, the padlock can pivot about one of the shackles while remaining attached thereto. The pivoting movement displaces the bottom of the padlock so that it permits free sliding passage of the bolt means rearwardly to the unlocked state of the lock.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

For convenience of description, the terms "front", "forward" and equivalent expressions will have reference to the right extremity of the illustrated embodiments, and the terms "rear", "rearward" and expressions of equivalent import will have reference to the left extremity of the illustrated embodiments of the lock.

DESCRIPTION OF THE PREFERRED EMBODIMENT

Figure 1:
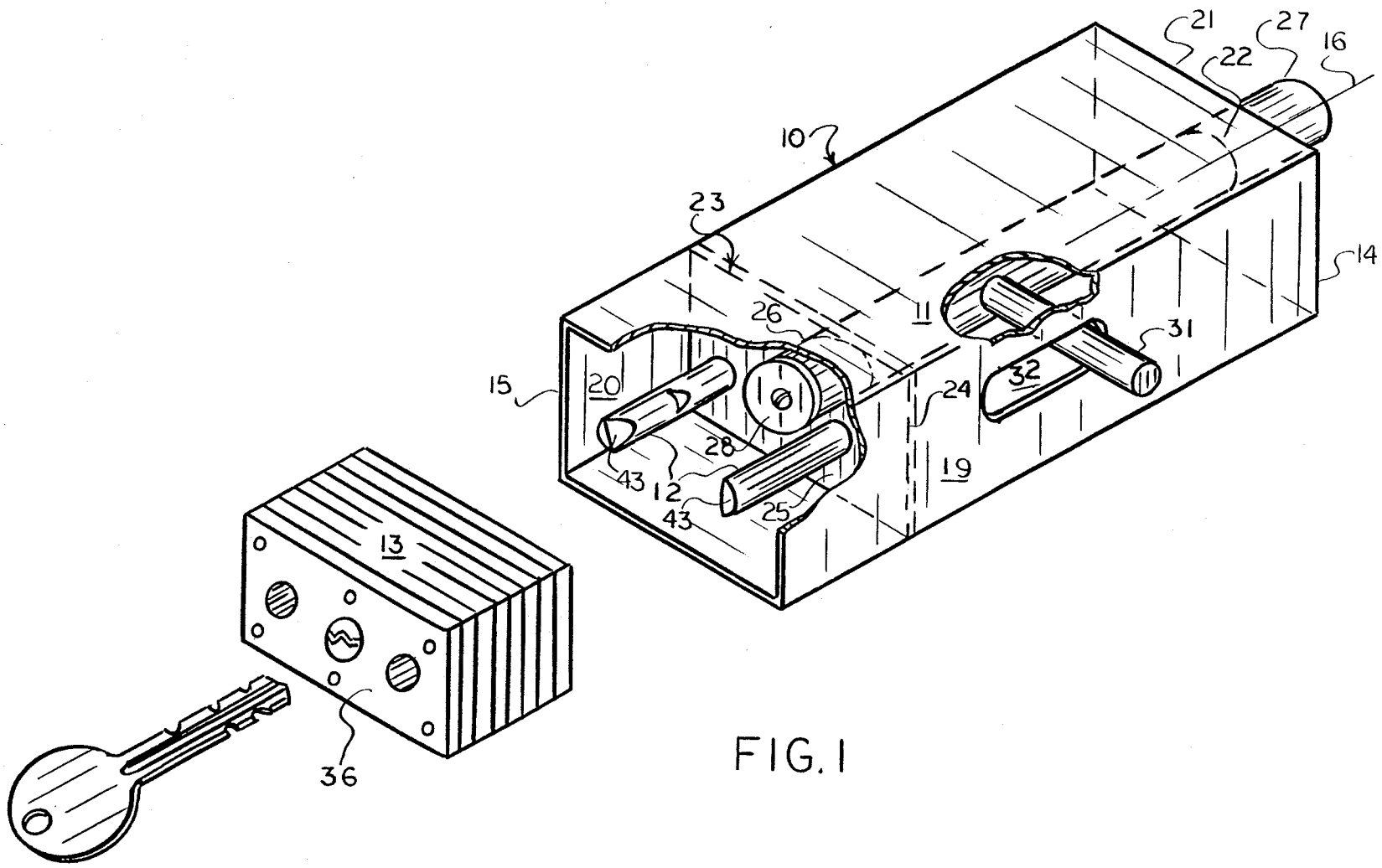
FIG. 1 is a partially exploded perspective view of a first embodiment of the lock of this invention showing the bolt in its locked position and with portions cut away to reveal interior detail.
Figure 2:
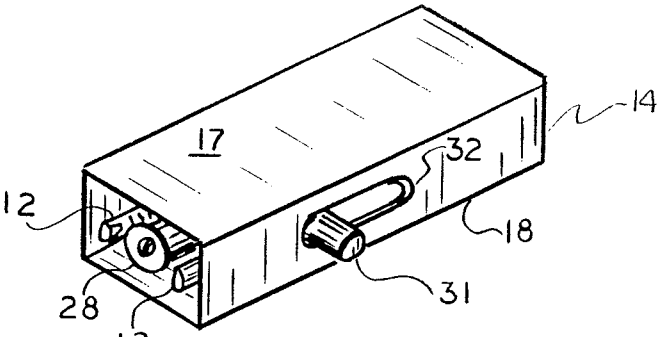
FIG. 2 is a perspective view of the lock of FIG. 1 in its unlock state.
Figure 3:
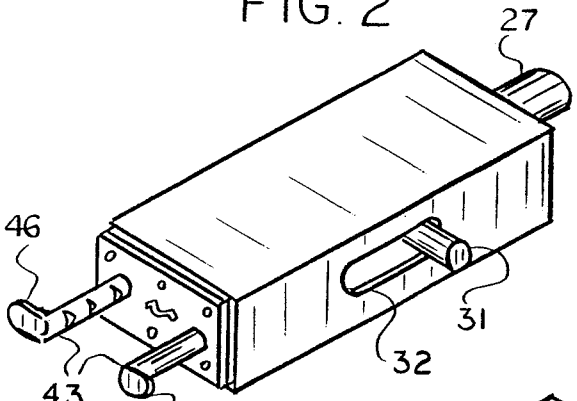
FIG. 3 is a perspective view of a second embodiment of the lock of this invention shown in its locked state.
Figure 4:
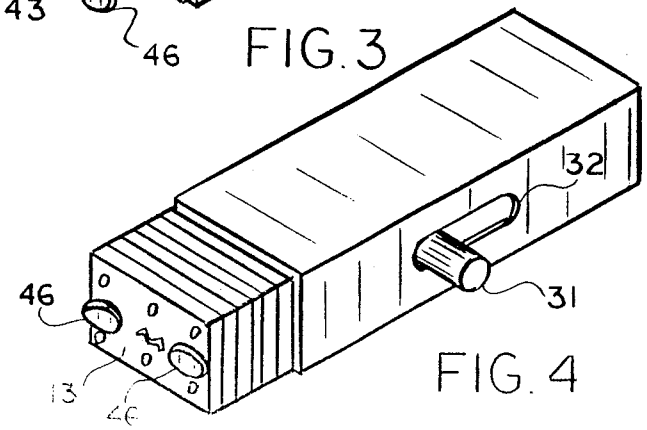
FIG. 4 is a perspective view of the lock of FIG. 3 in its unlocked state.
Figure 6:
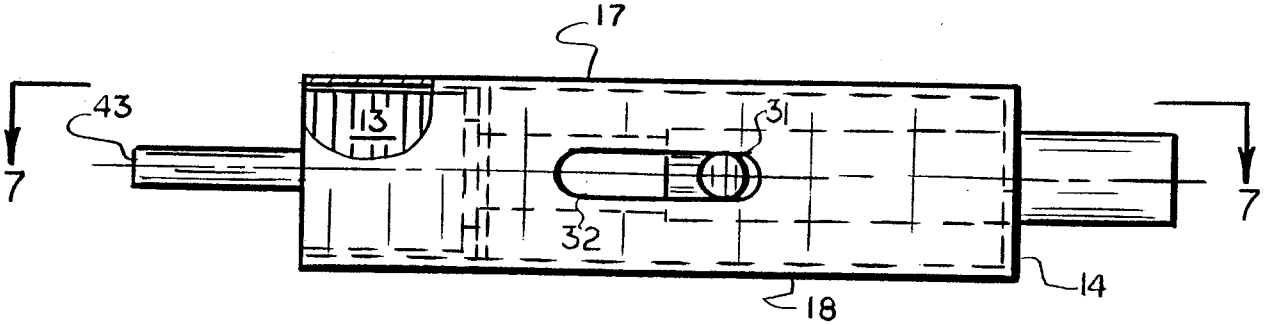
FIG. 6 is a bottom view of the lock of FIG. 1.

Referring to FIGS. 1 and 2, a first embodiment of the lock of this invention is shown comprised of housing 10 interactively accommodating bolt means 11, paired shackle posts 12, and padlock 13.

Housing 10 is elongated between front and rear extremities 14 and 15, respectively, and may be characterized in having a centered axis 16. The housing is comprised of opposed side panels 17 and 18, and opposed end panels 19 and 20. The panels may be fabricated from plate iron stock and joined in a box-like configuration by welding. Alternatively, the box-like configuration may be secured by the bending of a single plate and welded joinder where its ends meet. In still other embodiments, the housing may be a segment cut from a continuous tubular extruded shape. Fabrication of the housing by a casting operation is a still further alternative. The interior of the illustrated housing is of uniformly rectangular contour, geometrically describable as being of a prismatic shape.

A first transverse wall 21 is disposed within the housing adjacent front extremity 14 in perpendicular orientation to axis 16 and in fixed engagement with the panels of said housing. A first aperture 22 is located within wall 21, centered upon axis 16.

A second transverse wall 23, bounded by opposed interior and exterior surfaces, 24 and 25, respectively, is disposed within said housing near rear extremity 15, and in perpendicular orientation to axis 16. Wall 23 is in fixed engagement with the panels of the housing and contains second aperture 26 centered upon axis 16.

Two parallel shackle posts 12 are attached to exterior surface 25 of wall 23 at sites equidistantly spaced from axis 16, and extend perpendicularly therefrom to distal extremities 43 extending to rear extremity 15. The shackle posts are of a substantially standard configuration and adapted to engage padlock 13.

Figure 7:
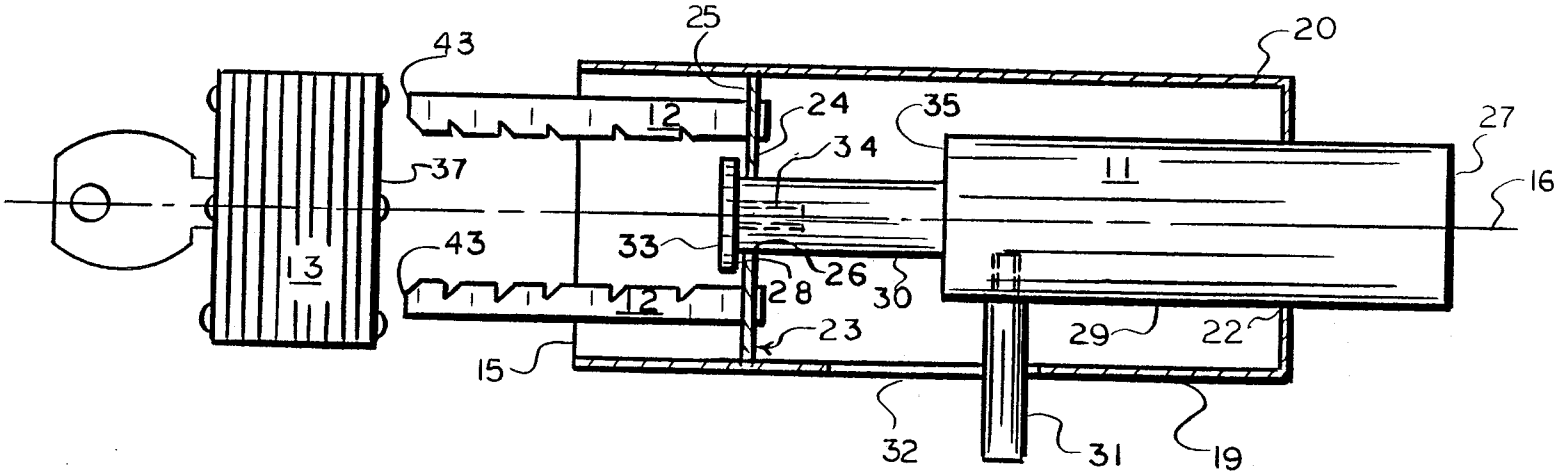
FIG. 7 is a partially exploded sectional view taken upon the line 7—7 of FIG. 6, and showing a modified bolt means.

Bolt means ll has forward and rearward extremities 27 and 28, respectively, defining a length which is a greater than the distance of separation between walls 21 and 23. The bolt is slidably held by apertures 22 and 26. Bolt means 11 may be a single bolt of uniform cross-sectional configuration throughout its length, or, as shown in FIG. 7, may be comprised of forward and rearward sections 29 and 30, respectively, having different shapes. Suitable cross-sectional configurations include circular, square and rounded square. The bolt is fabricated of a metal such as an iron alloy which is difficult to saw through, and may be further equipped with a sleeve rotatable about axis 16, thereby thwarting sawing attempts.

A manipulating arm 31 is perpendicularly attached to bolt means 11, and extends through a close-fitting slotted opening 32 in end panel 19. The extremities of said opening may constitute means for limiting the extent of sliding travel of bolt means 11 in either forward or rearward directions. Additional means for limiting the travel of bolt means 11 may be washer 33 attached by threaded bolt 34 to the rearward extremity of bolt means 11. Still other travel-limiting means may be in the form of a shoulder 35 formed at the junction of two sections of bolt means 11, as shown in FIG. 7. Such shoulder limits rearward travel by abuting against interior surface 24 of wall 23. A further embodiment of the means for limiting the extent of sliding travel of bolt means 11 is exemplified in FIG. 10 as stop screws 45 that threadably engage bolt means 11 in aligned, spaced apart relationship. Said stop screws are inaccessible unless the device is unlocked, handle 31 is removed, and bolt means 11 is rotated so that screws 45 line up with slot 32.

It is to be noted that, the length of bolt means 11 and the function of the travel-limiting means are such that, in the unlocked state, forward extremity 27 of bolt means 11 is flush fitting with front extremity 14 of the housing.

Padlock 13, configured to enter the rear extremity 15 of the housing while engaging shackle posts 12, has a rearwardly directed key-receiving extremity 36 and an opposite, forwardly directed bottom extremity 37. The padlock preferably makes a close fit with the interior of the housing. In the fully seated, locked position of the padlock upon the shackles, its bottom extremity 37 resides in close adjacency to exterior surface 25 of wall 23. In this position, said bottom extremity 37 serves as an abutment stop for bolt means 11.

In the first embodiment of the lock of this invention, in order to unlock the lock or use it merely as a latch bolt, the padlock is completely removed. In the case of the second embodiment, illustrated in FIGS. 3, 4, 7 and 8, the padlock is adapted to move to a more rearward position upon the shackle posts to achieve unlocking. In said second embodiment stopping shoulders 46 may be disposed upon the distal extremities 43 of the shackle posts. The stopping shoulders, which may be continuous integral appendages of the shackle posts, prevent removal of padlock 13.

Figure 5:
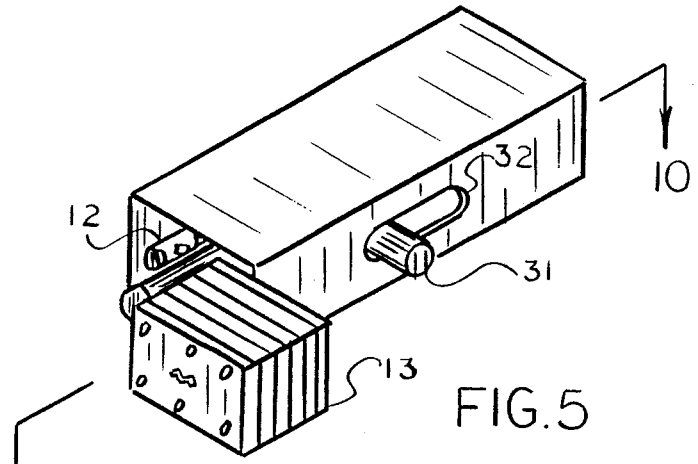
FIG. 5 is a perspective view of a third embodiment of the lock in its unlocked state.
Figure 10:
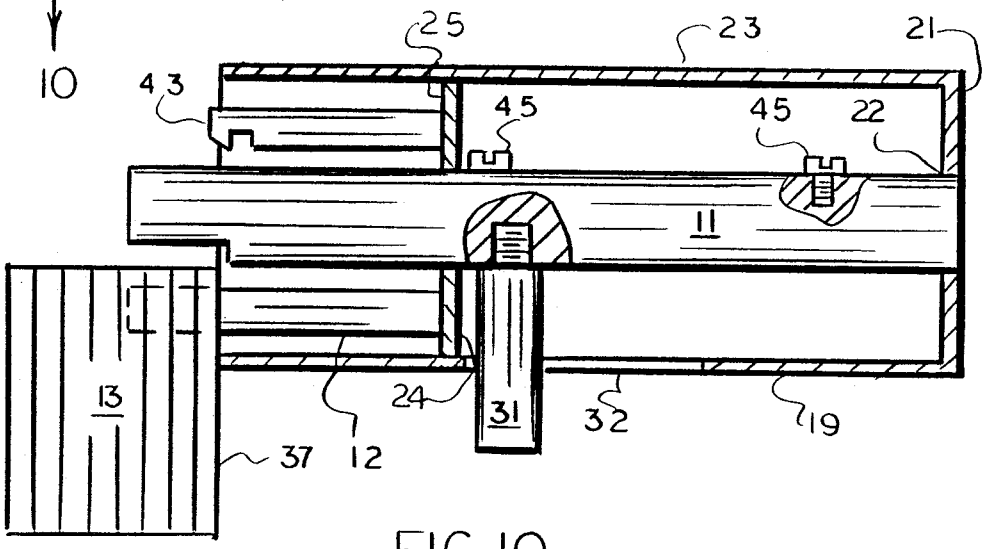
FIG. 10 is a sectional view taken upon the line 10—10 of FIG. 5.

In the case of the third embodiment, illustrated in FIGS. 5 and 10, the padlock is adapted to be retainably pivotable upon one of the shackle posts in its rearwardmost position upon the shackle post. By virtue of such modification, the lock can be unlocked without separating the padlock therefrom. It is to be noted however, that in such modification the rearward extremity of the bolt means may be narrowed, as shown in FIG. 10, or otherwise configured or positioned so as to bypass the padlock.

Figure 8:
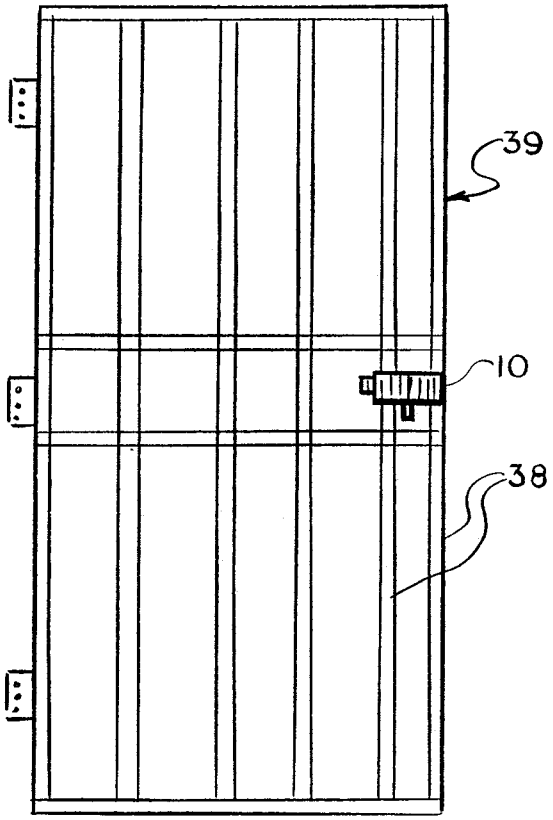
FIG. 8 is a front view of a gate having welded thereupon a lock of the present invention.

A typical manner of mounting the lock to a gate is shown in FIG. 8, where side panel 18 of the housing is welded upon the vertical bars 38 of swinging gate 39.

Figure 9:
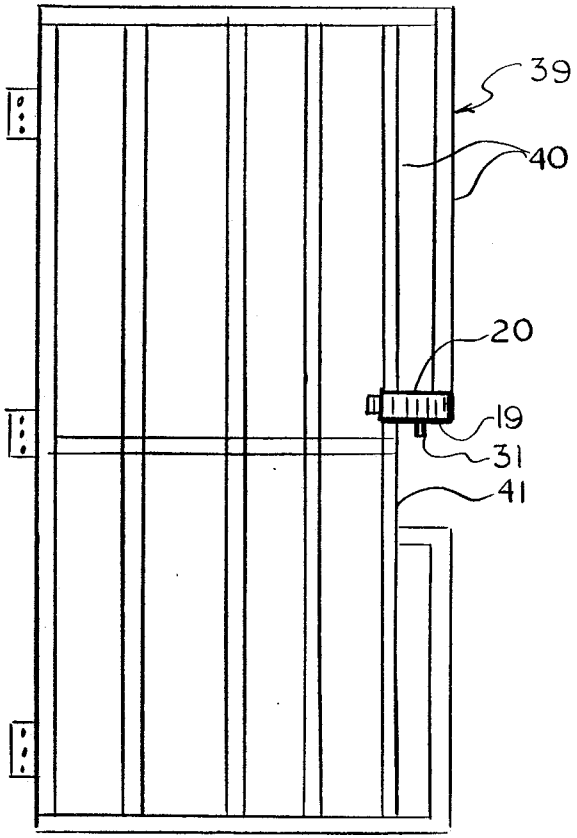
FIG. 9 is a front view of an iron bar gate having a lock of the present invention inserted between the bars.

In the manner of installation shown in FIG. 9, end panel 20 of the housing is welded to the lower end extremities of bars 40 of gate 39, and end panel 19 is welded to the upper extremity of gate bar 41. By virtue of such manner of mounting, the lock resides substantially within the plane of the gate.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A lock for gate structures comprising:

(a) a sturdy metal housing elongated upon a centered axis between front and rear extremities, and comprised of opposed side panels and opposed end panels, said panels being joined in a box-like configuration having as interior of uniformly rectangular contour, (b) a first transverse wall disposed within said housing adjacent said front extremity in perpendicular orientation to said axis and having an aperture therein centered upon said axis, (c) a second transverse wall, bounded by opposed interior and exterior surfaces, disposed with said housing close to said rear extremity in perpendicular orientation to said axis and having an aperture therein centered upon said axis, (d) two parallel shackle posts attached to the exterior surface of said second transverse wall at sites equidistantly spaced from said axis and extending perpendicularly therefrom to distal extremities located rearwardly of the rear extremity of the housing, (e) bolt means having forward and rearward extremities defining a length greater than the distance of separation between said transverse walls,said bolt means being slidably held by the apertures in said walls, (f) a manipulating arm perpendicularly attached to said bolt and extending through a close-fitting slotted opening in one of said end panels, (g) means for limiting the extent of sliding motion of the bolt means in forward and rearward directions, (h) a padlock configured to enter the rear extremity of said housing while engaging said shackle posts, said padlock having a rearwardly directed key-receiving extremity and an opposite, forwardly directed bottom extremity, whereby (i) when said padlock is emplaced upon said shackle posts, the rearward extremity of said bolt means abuts against the bottom extremity of said padlock, thereby fixing the forward extremity of the bolt means in a disposition forwardly displaced from the front extremity of the housing, and (j) when said padlock is removed, said bolt means can slide rearwardly so that its forward extremity no longer protrudes forwardly of said housing.

2. The lock of claim 1 wherein said padlock is adapted to make close-fitting sliding engagement with the interior of the housing.

3. The lock of claim 1 wherein said shackle posts are attached by welding to the exterior surface of said second transverse wall.

4. The lock of claim 1 wherein said shackle posts are threadably attached to said second transverse wall in a manner permitting replacement of said posts.

5. The lock of claim 1 wherein the interaction between the padlock and shackle posts is such that, in its unlocked state, the padlock can pivot about one of said shackle posts while remaining attached thereto, said pivoting movement permitting rearward movement of the bolt means.

6. The lock of claim 1 wherein said close-fitting slotted opening serves as means for limiting the extent of sliding motion of the bolt means.

7. The lock of claim 1 wherein said means for limiting the extent of sliding motion of the bolt means comprises at least one threaded stop screw which is inaccessible unless the lock is dismantled.

8. The lock of claim 1 wherein said bolt means is of uniform cross-sectional configuration throughout its length.

9. The lock of claim 1 wherein said bolt means is comprised of forward and rearward portions having different cross-sectional configurations.

10. The lock of claim 1 wherein stopping means are associated with the distal extremities of said shackle posts to prevent removal of the padlock.

* * * * *